US006267630B1

(12) United States Patent
Machado

(10) Patent No.: US 6,267,630 B1
(45) Date of Patent: Jul. 31, 2001

(54) CIRCULAR CONNECTOR WITH BLADE TERMINAL

(75) Inventor: Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 09/450,322

(22) Filed: Nov. 29, 1999

Related U.S. Application Data

(60) Provisional application No. 60/147,060, filed on Aug. 4, 1999.

(51) Int. Cl.[7] ..... H01R 4/02

(52) U.S. Cl. ..... 439/876; 228/114.5

(58) Field of Search ..... 439/874, 876, 439/83, 78; 228/114.5

(56) References Cited

U.S. PATENT DOCUMENTS

| | | | | |
|---|---|---|---|---|
| 2,709,211 | | 5/1955 | Glynn | 201/63 |
| 2,787,693 | | 5/1957 | Razlag | 219/19 |
| 3,534,148 | | 10/1970 | Bange | 174/68.5 |
| 3,553,833 | | 1/1971 | Jochim et al. | 29/611 |
| 3,634,654 | | 1/1972 | Peetz et al. | 219/522 |
| 3,813,519 | | 5/1974 | Jochim et al. | 219/522 |
| 3,972,580 | | 8/1976 | Pemberton et al. . | |
| 3,981,556 | | 9/1976 | Sabatelli et al. . | |
| 4,023,008 | | 5/1977 | Durussel | 219/522 |
| 4,246,467 | | 1/1981 | Boaz | 219/522 |
| 4,361,751 | | 11/1982 | Criss et al. | 219/522 |
| 4,425,021 | | 1/1984 | Nicolino . | |
| 4,450,346 | | 5/1984 | Boaz | 219/522 |
| 4,453,669 | | 6/1984 | Karla et al. | 237/12.3 |
| 4,502,750 | | 3/1985 | Neidig et al. . | |
| 4,618,209 | * | 10/1986 | Sonobe | 438/83 |
| 4,719,317 | | 1/1988 | Reynolds et al. | 174/94 |
| 4,878,850 | | 11/1989 | Letemps et al. | 439/83 |
| 4,972,295 | * | 11/1990 | Suguro et al. | 361/720 |
| 5,023,403 | | 6/1991 | Eckardt et al. | 174/94 |
| 5,136,122 | | 8/1992 | Kwitkowski et al. | 174/94 |
| 5,208,444 | | 5/1993 | Winter et al. | 219/547 |
| 5,213,828 | | 5/1993 | Winter et al. | 428/46 |
| 5,543,601 | | 8/1996 | Bartrug et al. | 219/203 |
| 5,738,554 | | 4/1998 | Borger et al. | 439/874 |
| 5,897,406 | | 4/1999 | Benes et al. | 439/859 |
| 6,039,616 | * | 3/2000 | Pereira et al. | 439/874 |
| 6,172,306 | * | 1/2001 | Downey | 439/876 |

OTHER PUBLICATIONS

Research Disclosure, Kenneth Masons Publications, Ltd, England, No. 31552, Jul. 1990.*

* cited by examiner

*Primary Examiner*—Neil Abrams
(74) *Attorney, Agent, or Firm*—Hamilton, Brook, Smith & Reynolds, PC

(57) ABSTRACT

A one piece electrical connector includes a base pad having a substantially round perimeter as well as top and bottom surfaces. A layer of solder covers the bottom surface of the base pad. An arm integral with the base pad is bent from the perimeter of the base pad. The arm extends over the top surface of the base pad and terminates in a terminal. The arm has a first portion bent to lie on the top surface of the base pad and a second portion extending from the first portion and bent to extend away from the base pad. The arm may be gripped by a rotatable chuck for spin soldering the base pad to pad to a glass substrate.

16 Claims, 3 Drawing Sheets

CIRCULAR CONNECTOR WITH BLADE TERMINAL

RELATED APPLICATION(S)

This application claims the benefit of U.S. Provisional Application No. 60/147,060, filed Aug. 4, 1999, the entire teachings of which are incorporated herein by reference.

BACKGROUND

Windshields and rear windows of vehicles such as automobiles often include electrical devices located within or on the glass. Typically, the electrical devices are antennas or defrosters. In order to provide an electrical connection to such an electrical device, a small area of metallic coating is applied to the glass which is electrically connected to the electrical device. An electrical connector for connecting to a lead is then soldered to the metallic coating on the glass.

Some of these electrical connectors are designed to have improved soldering capabilities to glass but typically are formed from multiple components and/or contain a specialized terminal which requires the connecting lead to have a specialized mating terminal.

SUMMARY OF THE INVENTION

The present invention provides a simple electrical connector which is easily and quickly soldered to a metallic coating on glass while, at the same time, mates with a standard terminal. The connector includes a base pad having a substantially rounded perimeter as well as top and bottom surfaces. A layer of solder covers the bottom surface of the base pad. An arm integral with the base pad is bent from the perimeter of the base pad. The arm extends over the top surface of the base pad and terminates in a terminal. The arm has a first portion bent to lie on the top surface of the base pad and a second portion extending from the first portion and bent to extend away from the base pad.

In preferred embodiments, the terminal is a blade terminal. The arm has a third portion forming the blade terminal extending from the second portion and bent to extend parallel to the top surface of the base pad. The first and second arm portions, and the second and third arm portions, are preferably at right angles relative to each other. The base pad includes a central axis wherein the second portion of the arm extends substantially along the central axis. The base pad also has a central opening extending through the base pad about the central axis. Furthermore, the connector is preferably formed from sheet metal.

Forming the present invention electrical connector from a single piece of sheet metal makes it low cost and easy to manufacture. In addition, the layer of solder on the lower surface of the base pad enables the connector to be soldered to a metallic coating on glass by spin soldering, where the connector is gripped in a rotatable chuck and rotated against the coated glass until the solder melts and bonds the connector thereto. Furthermore, the rounded perimeter of the base pad eliminates sharp corners which can cause damage to the glass while the base pad is spinning. The rounded perimeter also eliminates the possibility of stress fractures in the glass which are formed by soldering sharp corners to glass. Finally, the blade type terminal is a standard connection which allows the use of standard mating terminals on connecting leads.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
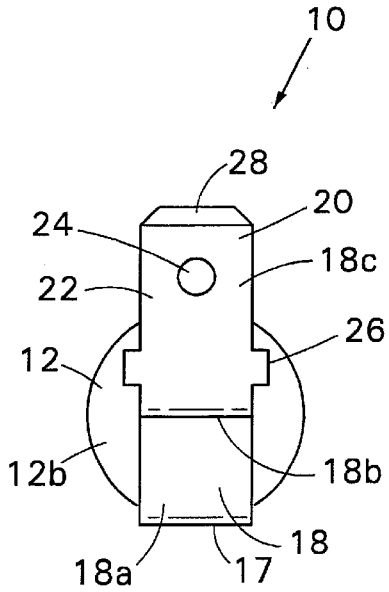
FIG. 1 is a top view of a preferred electrical connector of the present invention.
Figure 2:
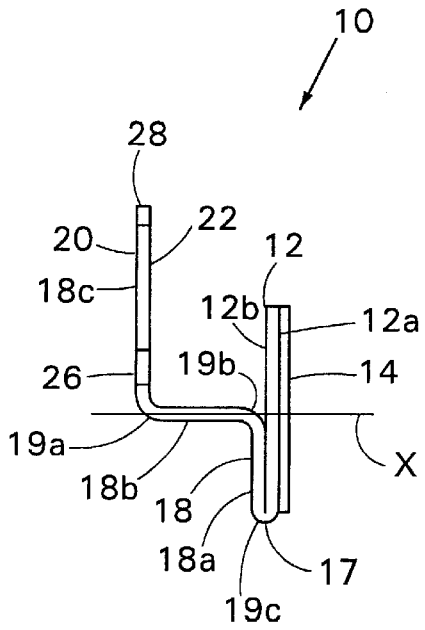
FIG. 2 is a side view of the connector of FIG. 1.
Figure 3:
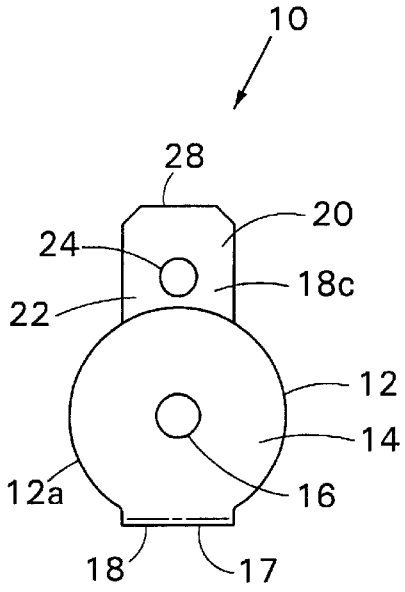
FIG. 3 is a bottom view of the connector of FIG. 1.

Referring to FIGS. 1–3, electrical connector 10 is a one piece connector for spin soldering to a metallic coating on glass. Connector 10 includes a flat base pad 12 having a substantially circular outer perimeter. The bottom surface 12*a* of base pad 12 is coated with a layer of solder 14 capable of melting when subjected to rotational friction against metallic coated glass during spin soldering. A central hole 16 extends through base pad 12 about the central axis X of base pad 12 which removes a region of base pad 12 that would have little or no velocity for generating friction during spin soldering. This allows the layer of solder 14 to quickly heat up and melt.

An arm 18 is bent upwardly from one edge of base pad 12 and includes a first arm portion 18*a*, a second arm portion 18*b* and a third arm portion 18*c* (FIG. 2). The edge of base pad 12 where arm 18 is bent forms a small flat edge region 17 on a portion of the perimeter of base pad 12 (FIG. 3). The first arm portion 18*a* is bent in a hair pin turn relative to base pad 12 and lies on the top surface 12*b* of base pad 12 about halfway across base pad 12. The second arm portion 18*b* is bent at a right angle upwardly from both the first arm portion 18*a* and base pad 12. Preferably, the second arm portion 18*b* extends along or close to the central axis X of base pad 12 (FIG. 2). The third arm portion 18*c* is bent at a right angle to the second arm portion 18*b* to be parallel with the first arm portion 18*a* and base pad 12. The third arm portion 18*c* is on the side of the second arm portion 18*b* opposite from the first arm portion 18*a* and extends beyond the perimeter of base pad 12. The third arm portion 18*c* forms a blade terminal 20 which has a flat blade 22, an angled tip 28, and two end stop projections 26 (FIG. 1). A hole 24 extends through the blade 22 for engaging with a protrusion on a mating terminal.

Figure 4:
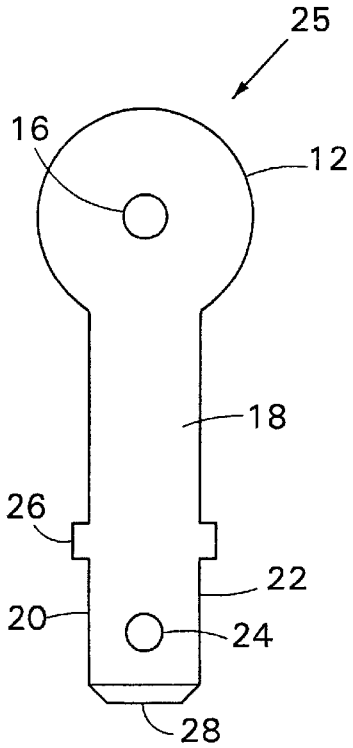
FIG. 4 is a plan view of the blank from which the connector of FIG. 1 is formed.

In order to manufacture connector 10, a flat blank 25 is first stamped from sheet metal as shown in FIG. 4. Preferably, blank 25 is stamped with the finished outline of connector 10 which includes the central hole 16 through base pad 12, as well as the angled tip 28, hole 24 and end stop projections 26 of blade terminal 20.

Next, bending operations are performed on the blank 25. A first bend 19*a* of about 90° is made in arm 18 just beyond the endstop projections 26 of blade terminal 20 to form the third arm portion 18*c*. A second bend 19*b* is made in arm 18 in a direction opposite to the first bend 19*a* to form the first 18*a* and second 18*b* arm portions. The second bend 19*b* is preferably performed in two steps by making about a 45° bend in a first bending operation and then continuing another 45° in a second bending operation to complete the second bend 19*b* as a 90° bend. A third bend 19*c* is made between arm 18 and base pad 12 for bending arm 18 upwardly from base pad 12. The third bend 19*c* is preferably performed in three steps by making about a 90° bend in a first bending operation, continuing another 45° in a second bending operation, and then continuing another 45° in a third bending operation to complete the third bend 19*c* as a 180° hairpin bend. This positions the first arm portion 18*a* across the top surface 12*b* of base pad 12. Although arm 18 is preferably bent in the order described above, alternatively, the order in which bends 19*a*–19*c* are made can be reversed. In addition, the number of bending operations for each bend 19*a*–19*c* can vary depending upon the situation at hand.

The layer of solder 14 is preferably applied to the bottom surface 12*a* of base pad 12 before the bending operations, but alternatively, can be applied to the base pad 12 after bending, or to the sheet metal before the blank 25 is stamped.

When spin soldering connector 10 to a metallic coating on glass, the arm 18 of connector 10 is gripped in the chuck of a spin soldering device and rapidly rotated while being pressed against the glass. Preferably, the second arm portion 18*b* is gripped since the second arm portion 18*b* extends along the central axis X of base pad 12 (FIG. 2). However, depending upon the chuck design, portions of the first 18*a* and third 18*c* arm portions may also be engaged. Gripping the second arm portion 18*b* allows base pad 12 to be rotated about its central axis X so that connector 10 spins smoothly without substantial wobble or eccentric rotation. This in combination with the rounded perimeter of base pad 12 reduces the chance of damage to the glass during spinning. The layer of solder 14 melts due to heat generated by friction between the layer of solder 14 and the metallic coating on the glass. Rotation of connector 10 is then stopped to allow the melted layer of solder 14 to bond the base pad 12 to the metallic coating on the glass.

In one preferred embodiment, connector 10 is made of sheet CDA260 brass about 0.03 inches thick (0.78 mm) and is tempered. The layer of solder 14 is preferably about 0.014 inches thick (0.35 mm) and has a composition of about 27% tin (Sn), 70% lead (Pb) and 3% silver (Ag). This composition has a melting point of about 450° F. Base pad 12 is about 0.47 inches in diameter (12 mm) with hole 16 being about 0.094 inches in diameter (2.4 mm). The perimeter of base pad 12 is substantially concentric with hole 16. Arm 18 is about 0.25 inches wide (6.3 mm) which is about half the diameter of base pad 12. The first arm portion 18*a* extends across the upper surface of base pad 12 about 0.27 inches (6.8 mm). By extending arm 18 halfway across the top surface 12*b* of base pad 12 and then bending arm 18 upwardly along the central axis X of base pad 12, arm 18 has a second arm portion 18*b* that is positioned in a location that is easily gripped for spinning connector 10 about the central axis X. In addition, making the third bend 19*c* about 180° so that the first arm portion 18*a* lies on the top surface 12*b* of the base pad 12 increases the structural strength of arm 18 which is needed during rotation since arm 18 is gripped at the centrally located second arm portion 18*b* but is joined to base pad 12 at the perimeter. Although the flat edge region 17 is shown to protrude slightly from the curved portion of the perimeter of base pad 12, alternatively, the third bend 19*c* of arm 18 can be made closer to the central axis X so that the flat edge region 17 does not protrude. The third portion 18*c* of arm 18 forming blade terminal 20 is about 0.43 inches long (11 mm) and is spaced from base pad 12 about 0.26 inches (6.68 mm). Since the length of the blade terminal 20 is about the same as the diameter of base pad 12, arm 18 is bent inwardly from the edge of base pad 12 rather than being stamped from material in the center of base pad 12. Protrusions 26 are located about 0.31 inches (8 mm) from tip 28, extend about 0.03 inches (0.85 mm) outwardly from the sides of third arm portion 18*c* and are about 0.08 inches long (2 mm). Hole 24 is about 0.16 inches away from tip 28 (4 mm) and is about 0.078 inches in diameter (2 mm).

Figure 5:
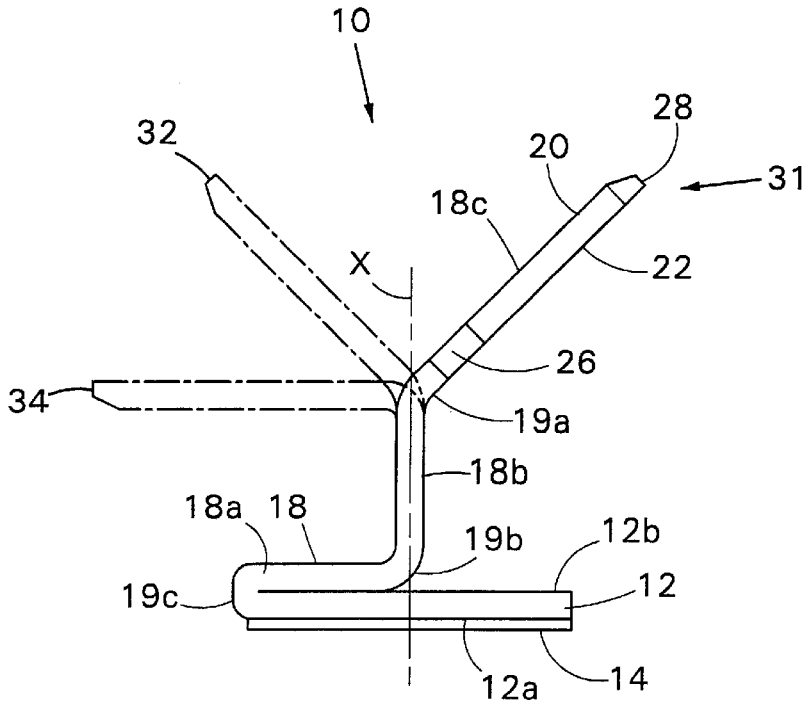
FIG. 5 is a side view of the connector of FIG. 1 with the blade terminal depicted in alternate positions.

Referring to FIG. 5, the blade terminal 20 of connector 10 can be bent into suitable positions other than that depicted in FIG. 2. For example, positions 31 and 32 (position 32 in phantom) depict blade terminal 20 at acute angles relative to the central axis X and on opposite sides thereof. Position 34 (in phantom) depicts blade terminal 20 at a 90° angle relative to the second arm portion 18*b* but on the opposite side than that depicted in FIG. 2.

Figure 6:
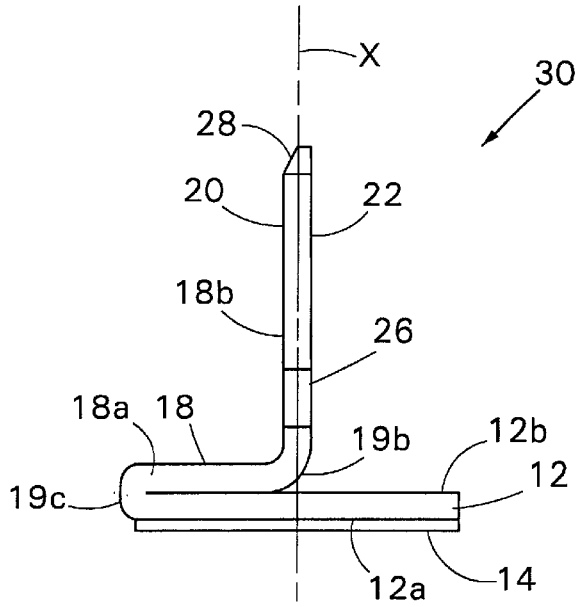
FIG. 6 is a side view of another preferred electrical connector.

FIG. 6 depicts another preferred connector 30 in which the third arm portion 18*c* is omitted so that arm 18 includes only a first arm portion 18*a* and a second arm portion 18*b* with the second arm portion 18*b* forming the blade terminal 20. The first arm portion 18*a* lies across the top surface 12*b* of base pad 12 and the second arm portion 18*b* which forms blade terminal 20 extends away from both the base pad 12 and the first arm portion 18*a* at a right angle to base pad 12 along the central axis X. Arm 18 has a bend l9*c* between arm 18 and base pad 12, and a bend l9*b* between the first arm portion 18*a* and the second arm portion 18*b*.

Figure 7:
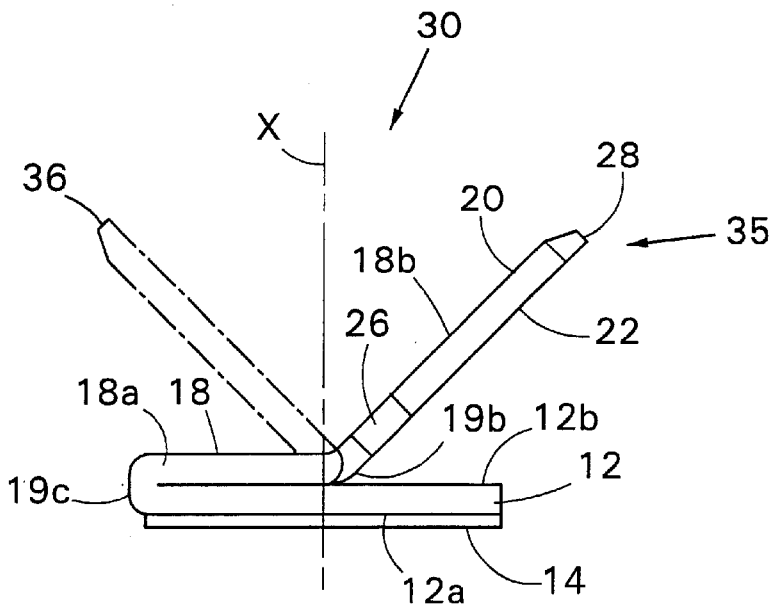
FIG. 7 is a side view of the connector of FIG. 6 with the blade terminal depicted in alternate positions.

FIG. 7 depicts alternative positions for the blade terminal 20 of connector 30. Blade terminal 20 can be acutely angled to either side of the central axis X as depicted in positions 35 and 36 (position 36 shown in phantom).

Figure 8:
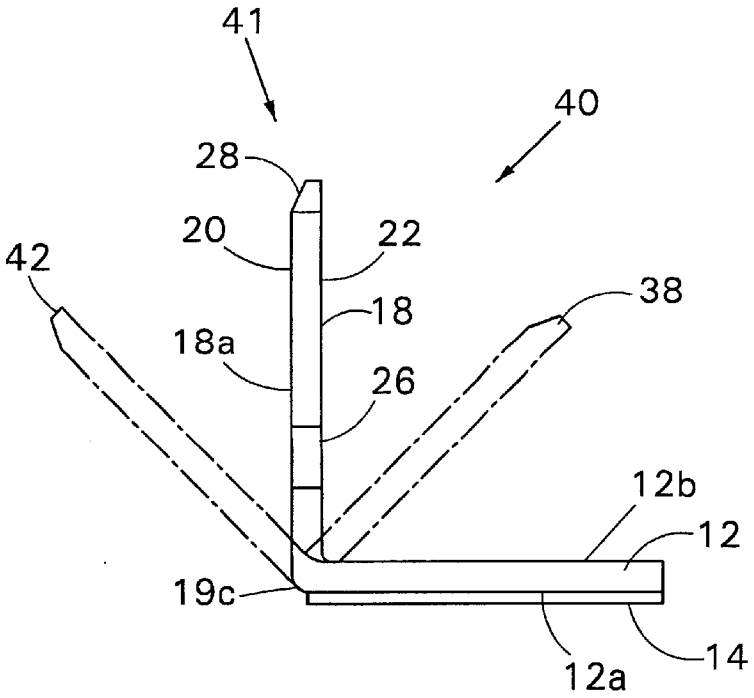
FIG. 8 is still another preferred electrical connector with the blade terminal depicted in alternate positions.

FIG. 8 depicts another preferred connector 40 in which arm portions 18*b* and 18*c* are omitted. Arm 18 includes only a first arm portion 18*a* which forms the blade terminal 20. The first arm portion 18*a* is bent upwardly from base pad 12 at bend 19*c*. Blade terminal 20 may be positioned in the vertical position 41 as well positions 38 and 42 (shown in phantom) which are acutely angled relative to the vertical position 41.

While this invention has been particularly shown and described with references to preferred embodiments thereof, it will be understood by those skilled in the art that various changes in form and details may be made therein without departing from the scope of the invention encompassed by the appended claims.

For example, although a particular type of brass has been specified for connector 10, other suitable conductive materials can be employed such as copper and copper alloys, aluminum and aluminum alloys, as well as other types of brass and brass alloys. In addition, although connector 10 is preferably formed from sheet metal, alternatively, connector 10 can be molded. Also, although a particular solder composition has been described, other suitable solder compositions can be employed. Furthermore, although particular dimensions have been given for connector 10, the dimensions of connector 10 can vary depending upon the application at hand. Blade terminal 20 can be at any suitable orientation or angle relative to base pad 12 in addition to the orientations and angles depicted in the figures. Although terms such as top, bottom, upwardly etc., have been used to describe the present invention electrical connector, such terms describe the orientation of features relative to each other and are not meant to limit the connector to a particular orientation. Although the present invention electrical connector has been depicted with one blade terminal 20, alternatively, more than one blade terminal 20 can be employed. Finally, although the present invention connector has been described to be spin soldered to a relatively flat piece of glass, alternatively, the connector can be soldered to concave or convex surfaces with base pad 12 including a mating surface, or soldered by other conventional methods.

What is claimed is:

1. An electrical connector comprising:

a base pad having a substantially round perimeter, and top and bottom surfaces;

a layer of solder on the bottom surface of the base pad; and an arm integral with the base pad bent from the perimeter of the base pad, the arm extending over the top surface of the base pad and terminating in a terminal, the arm having a first portion bent to lie on the top surface of the base pad and a second portion extending from the first portion bent to extend away from the base pad.

2. The connector of claim 1 in which the terminal is a blade terminal.

3. The connector of claim 2 in which the arm has a third portion extending from the second portion and bent to extend parallel to the top surface of the base pad, the third portion forming the blade terminal.

4. The connector of claim 3 in which the first and second arm portions, and the second and third arm portions, are at right angles relative to each other.

5. The connector of claim 1 in which the base pad has a central axis, the second portion of the arm extending substantially along the central axis.

6. The connector of claim 5 in which the base pad has a central opening extending through the base pad about the central axis.

7. The connector of claim 1 in which the connector is formed from sheet metal.

8. An electrical connector comprising:

a base pad having a substantially round perimeter, top and bottom surfaces, and a central opening extending through the base pad substantially concentric with the perimeter;

a layer of solder on the bottom surface of the base pad; and an arm integral with the base pad extending from the perimeter of the base pad and over the top surface of the base pad, the arm terminating in a blade terminal, the arm having a first portion bent to lie on the top surface of the base pad and a second portion extending, from the first portion bent to extend away from the base pad.

9. The connector of claim 8 in which the connector is formed from sheet metal.

10. The connector of claim 9 in which the arm is bent upwardly from the perimeter of the base pad.

11. The connector of claim 10 in which the arm has a first portion bent to lie on the top surface of the base pad and a second portion extending from the first portion bent to extend away from the base pad.

12. The connector of claim 10 in which the base pad has a central axis, the second portion of the arm extending substantially along the central axis.

13. The connector of claim 12 in which the arm has a third portion extending from the second portion and bent to extend parallel to the top surface of the base pad.

14. The connector of claim 13 in which the third portion of the arm forms the blade terminal.

15. The connector of claim 14 in which the first and second arm portions, and the second and third arm portions, are at right angles relative to each other.

16. An electrical connector comprising:

a base pad having a substantially round perimeter, and top and bottom surfaces; and an arm integral with the base pad bent from the perimeter of the base pad, the arm extending over the top surface of the base pad and terminating in a terminal, the arm having a first portion bent to lie on the top surface of the base pad and a second portion extending from the first portion bent to extend away from the base pad.

* * * * *

UNITED STATES PATENT AND TRADEMARK OFFICE

CERTIFICATE OF CORRECTION

PATENT NO. : 6,267,630 B1
DATED : July 31, 2001
INVENTOR(S) : Manuel Machado

It is certified that error appears in the above-identified patent and that said Letters Patent is hereby corrected as shown below:

Column 6, claim 8,
Line 8, after "extending" delete ",".

Signed and Sealed this

Twenty-ninth Day of January, 2002

*Attest:*

*Attesting Officer*

JAMES E. ROGAN
*Director of the United States Patent and Trademark Office*